US005840657A

United States Patent [19]

Mehta et al.

[11] Patent Number: 5,840,657

[45] Date of Patent: Nov. 24, 1998

[54] IMAGABLE LINERLESS PRESSURE SENSITIVE ADHESIVE

[75] Inventors: Rajendra Mehta, Centerville; David F. Laurash, Bellbrook; Mark Dotson; A. Dale Lakes, both of Dayton; Lawrence W. Arway, Kettering, all of Ohio

[73] Assignee: The Standard Register Company, Dayton, Ohio

[21] Appl. No.: 791,537

[22] Filed: Jan. 31, 1997

Related U.S. Application Data

[63] Continuation of Ser. No. 462,576, Jun. 5, 1995, abandoned, which is a continuation-in-part of Ser. No. 198,353, Feb. 18, 1994.

[51] Int. Cl.[6] ..... B41M 5/40

[52] U.S. Cl. ..... 503/204; 427/152; 503/206; 503/226

[58] Field of Search ..... 428/40, 343, 352, 428/354, 473.5, 900; 503/200, 226, 204, 206, 215

[56] References Cited

U.S. PATENT DOCUMENTS

| | | | |
|---|---|---|---|
| Re. 32,249 | 9/1986 | Esmay | 428/40 |
| 3,565,005 | 2/1971 | Knott | 101/171 |
| 4,562,102 | 12/1985 | Rabuse et al. | 428/43 |
| 4,587,167 | 5/1986 | Maietti et al. | 428/352 |
| 4,599,260 | 7/1986 | Truskolaski et al. . | |
| 4,627,641 | 12/1986 | Kawaguchi | 283/81 |
| 4,707,211 | 11/1987 | Shibata | 156/354 |
| 4,724,166 | 2/1988 | de Bruin | 427/208.8 |
| 4,768,810 | 9/1988 | Mertens | 282/12 A |
| 4,772,512 | 9/1988 | Nagafuchi | 428/331 |
| 4,784,714 | 11/1988 | Shibata | 156/354 |
| 4,851,383 | 7/1989 | Fickenscher et al. | 503/200 |
| 4,889,877 | 12/1989 | Seitz | 523/161 |
| 4,895,747 | 1/1990 | Birkholz | 428/42 |
| 5,089,538 | 2/1992 | Anderson | 523/132 |
| 5,102,856 | 4/1992 | Doll et al. | 503/209 |
| 5,168,002 | 12/1992 | Maietti | 428/352 |
| 5,183,696 | 2/1993 | Sanderson | 428/194 |
| 5,242,650 | 9/1993 | Rackovan et al. | 264/509 |
| 5,273,798 | 12/1993 | Miner | 428/40 |
| 5,292,713 | 3/1994 | Stenzel et al. | 503/226 |
| 5,328,538 | 7/1994 | Garrison | 156/249 |
| 5,462,909 | 10/1995 | Lakes et al. | 503/201 |
| 5,508,247 | 4/1996 | Tran et al. | 503/200 |

FOREIGN PATENT DOCUMENTS

| | | | |
|---|---|---|---|
| 191003 | 8/1986 | European Pat. Off. | 428/354 |
| 385647 | 9/1990 | European Pat. Off. | 428/40 |
| 460649 | 12/1991 | European Pat. Off. | 428/40 |
| 600622 | 6/1994 | European Pat. Off. | 503/226 |
| 60-54842 | 9/1983 | Japan | 503/226 |
| 90/13064 | 11/1990 | WIPO | 428/211 |
| WO 90/13064 | 11/1990 | WIPO | 428/195 |

OTHER PUBLICATIONS

"Color Printers and SWIRL Linerless Thermal Transfer Star at Scan–Tech '94", BIS Strategic Decisions, Dec. 1994, pp. 1–9.

*Primary Examiner*—Bruce H. Hess
*Attorney, Agent, or Firm*—Killworth, Gottman, Hagan & Schaeff, L.L.P.

[57] ABSTRACT

A linerless continuous series of pressure sensitive adhesive labels is provided which have on one or more selected portions thereof a series of imagable coatings which may be activated to form colored images or areas. The series of labels include a web having first and second surfaces, with a series of imagable coatings of color formers and color developers on the first surface of the web. A coating of a release material overlies the imagable coatings on the first surface of the substrate, and a coating of a pressure sensitive adhesive is positioned on the second surface of the web. The series of labels are wound or stacked so that the coating of pressure sensitive adhesive contacts the release material to permit individual labels to be dispensed.

20 Claims, 4 Drawing Sheets

IMAGABLE LINERLESS PRESSURE SENSITIVE ADHESIVE

CROSS-REFERENCE TO RELATED APPLICATION

This application is a continuation of U.S. application Ser. No. 08/462,576 filed Jun. 5, 1995, now abandoned which is a continuation-in-part of U.S. application Ser. No. 08/198,353, filed Feb. 18, 1994.

BACKGROUND OF THE INVENTION

The present invention relates to a series of linerless pressure sensitive adhesive labels having imagable coatings thereon and more particularly, to a series of linerless labels comprising a web including on selected portions of its surface a series of coatings of color formers and color developers which may be activated, when subjected to heat or pressure, to form colored areas or images.

In the field of product labeling, direct thermal printing has been a well-known means of non-impact printing. Direct thermal printers are capable of forming images by the application of heat to a substrate containing heat-reactive chemicals thereon. Typically, a substrate such as paper is coated with a coating of color forming and color developing reactants which, when heated, combine to form a visible color. When such a coated substrate passes under the print head of a thermal printer, selected areas containing the coating are activated by the heated print elements, forming colored images on the surface of the substrate.

It is also possible to achieve colored images from the use of self-contained carbonless coatings which produce colored images upon the application of pressure such as that from an impact printer. Such coatings are known, and typically contain dispersed color developers and initially colorless leuco dyes contained in solution within microcapsules.

Pressure sensitive adhesive labels utilizing such heat or pressure-sensitive imagable coatings generally include a substrate having the coatings on its surface, and a pressure sensitive adhesive on the surface of the substrate opposite that of the imagable coatings. However, typical pressure sensitive adhesive label products in current use require that a release liner overly and cover the pressure sensitive adhesive so that the labels may be fed through and imaged in printers. Otherwise, any exposed pressure sensitive adhesive will interfere with the handling and printing process. Such liners, however, add to the expense of manufacturing labels, add thickness and stiffness to the labels, and create disposal problems for the discarded liner material.

Attempts have been made to coat a release layer on the surface of the labels which eliminates the need for a liner ply and enables the labels to be wound upon themselves into a roll form without transfer of adhesive to the surface of the label. For example, Fickenscher et al, U.S. Pat. No. 4,851,383 teach a thermosensitive pressure sensitive label in which the thermosensitive layer is covered with a silicone layer to enable the labels to be rolled without the use of a release liner. However, the use of a barrier layer is also required between the thermosensitive layer and silicone layer to prevent discoloration or unwanted color formation in the thermosensitive layer.

In addition, such labels are fully coated with a thermosensitive layer and thus do not provide a method for providing different colored areas or images on a series of labels. For example, it may be desirable to provide different colored areas or images on selected portions of a label to delineate or differentiate information, or to designate how the article to which the label is attached is to be processed.

Accordingly, there remains a need in this art for linerless pressure sensitive adhesive labels which may be provided in roll form. There also remains a need for a series of such labels having selected portions which may be activated by heat or pressure to form colored images or areas.

SUMMARY OF THE INVENTION

The present invention meets those needs by providing a series of linerless pressure sensitive adhesive labels having on selected portions thereof a series of imagable coatings which may be activated to form colored images or areas. The labels may be provided in the form of a continuous series of labels wound in a roll. Alternatively, the series of labels may be stacked atop one another. In either embodiment, the labels may be dispensed one at a time from the roll or stack.

According to one aspect of the invention, a linerless continuous series of labels is provided comprising a web having first and second major surfaces. The web is preferably selected from the group consisting of coated or uncoated paper, liner stock, calendar liner, thermoplastic polymeric film, and heat-resistant polymeric film. One heat resistant polymeric film, for example, is a polyimide film.

The first surface of the web includes on one or more selected portions thereof a series of imagable coatings of color formers and color developers which may be activated to form colored images or areas. A coating of release material is applied to the first surface of the web and preferably overlies the coatings of color formers and color developers. A coating of a pressure sensitive adhesive is positioned on the second surface of the web. In an alternative embodiment, the pressure sensitive adhesive may be pattern coated on the second surface of the web.

In one embodiment of the invention, the series of labels are wound so that the coating of pressure sensitive adhesive on the second surface of the web contacts the release material on the first surface of the web to permit individual labels to be unwound and dispensed from the roll. If wound on a roll, cross perforations may also be provided between individual ones of the series of labels to aid in dispensing them, although the labels may also be dispensed from a device which includes a cutting edge for severing individual labels from the roll.

In an alternative embodiment of the invention, the labels comprise a series of substrates where the first surface of each substrate includes on one or more selected portions thereof an imagable coating of color formers and color developers, a coating of release material which overlies the imagable coating, and a coating of pressure sensitive adhesive on the second surface of each substrate. In this embodiment, the series of labels are stacked so that the coating of pressure sensitive adhesive on the second surface of one label contacts the release material on the first surface of the adjacent label in the stack.

In a preferred embodiment of the invention, a base coating is applied to the web or substrate surface prior to the application of the release material. The base coating acts to fill voids or irregularities in the substrate and provides a smooth, receptive surface for the release material. Preferably, the release material and pressure sensitive adhesive are selected to provide a release value when the labels are unwound or peeled from a stack at a 90° angle of from about 60 to 160 gm/2 inch width.

The color formers and color developers on the web combine to form colored visible areas including images, symbols, indicia or the like, when exposed to an imaging force which may take the form of heat or pressure. Preferably, the color formers comprise initially colorless leuco dyes, while the color developers comprise acidic phenolic compounds or resins. The color formers and developers are preferably contained in a binder matrix as separately dispersed particulate solids.

Exposure of the coatings to heat such as from a thermal printer causes selected reactants to melt, permitting the color former and color developer to mix and react. In one embodiment, such thermally activated coatings may be coated on the web as a pattern such as stripes, etc.

In an alternative embodiment of the invention, the color formers and color developers combine upon exposure to pressure such as an impact printing device. In this embodiment, the imagable coatings comprise self-contained coatings of pressure-rupturable microcapsules containing either color farmers or color developers.

The imagable coatings, whether activated by heat or pressure, may form a plurality of different colors on the web. For example, one portion of the form may be activated to form a first color, while another portion of the form is activated to form a second color. It is also within the scope of the invention to activate selected portions of the coated areas so as to produce only one color. For example, coatings which produce different colors may be coated in a side-by-side relationship around the periphery of a label in the series. By activating selected areas, the periphery can be made to show a selected color.

While it is possible to coat the web in a number of different areas so that multiple colored images are formed when the web is passed through a printer, it is also possible to coat only one selected area of the web. In one embodiment of the invention, the web is coated on selected portions with a series of imagable coatings with the remaining areas of the web not containing the imagable coatings. For example, if a bar code is to be thermally imaged on a label, the coating may be applied to one section of a label where the bar code is to be printed. The imagable coatings may be applied to the web in a number of different patterns, depending on the desired end use.

In a preferred embodiment, a series of repetitive images are printed on at least a portion of one surface of the web, where each of the repetitive images corresponds to an individual label in the series of labels. Preferably, the repetitive images are printed on a portion of the web which does not include the imagable coatings. Accordingly, it is a feature of the present invention to provide a linerless continuous series of labels having imagable coatings on selected portions which may be activated to produce colored images or areas. Other features and advantages of the invention will be apparent from the following description, the accompanying drawings, and the appended claims.

DETAILED DESCRIPTION OF THE PREFERRED EMBODIMENTS

With reference to the drawings, it must be appreciated that Patent Office requirements for solid black line drawings on a white surface make illustration of some of the subtleties of our invention relating to different colors difficult by the required Patent Office drawings alone. Reference to the following detailed description of the illustration will make full appreciation of the drawings and our invention possible.

Figure 1:
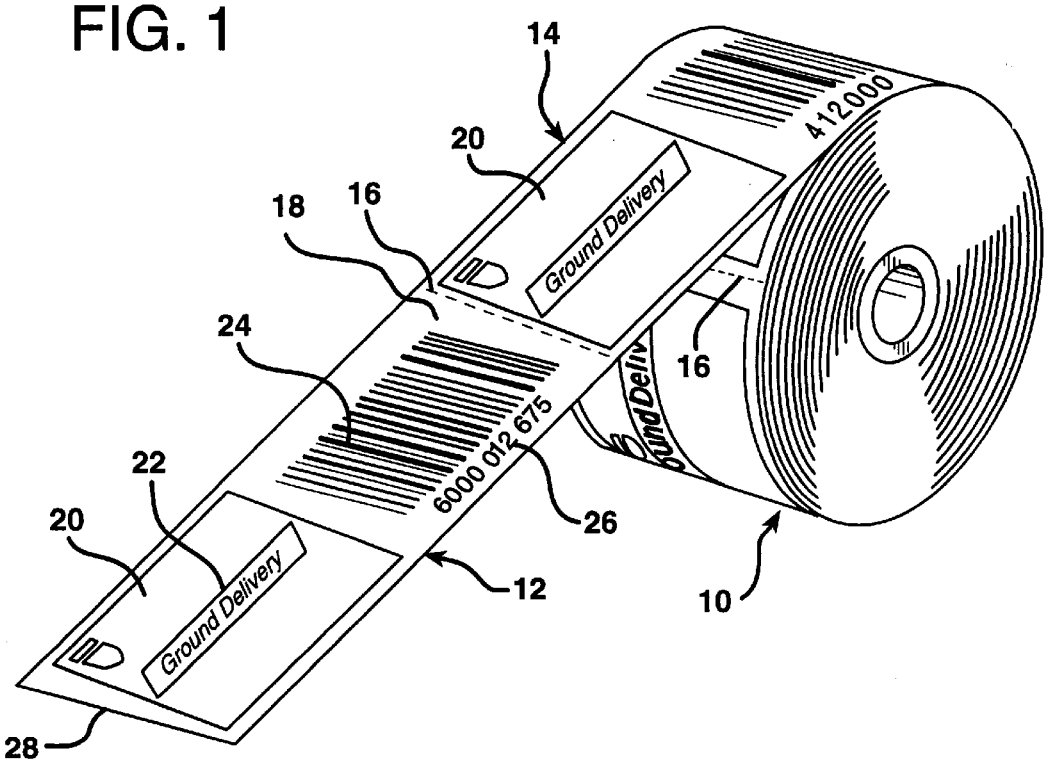
FIG. 1 is a perspective view of a roll of labels in accordance with the present invention.

Referring now to FIG. 1, one embodiment of the series of linerless labels is shown in roll form 10 comprising a web 28 having individual labels 12, 14, etc. The individual labels may be unwound and severed from roll 10 along perforations 16. Alternatively, if the roll is mounted in a dispenser having a cutting edge, the perforations may be omitted, and the individual labels may be unwound and severed as needed.

The first surface of the web 28 includes a selected area 18 containing an imagable coating of initially colorless color formers and color developers. As shown, the coated area 18 has been imaged to provide a bar code 24 and numbers 26 on the labels.

The web also includes an area 20 which does not contain the imagable coating but which contains a repetitive image 22. By repetitive image, we mean any background, symbol, object, lettering, or numbering which is common to and repeated for each of the individual labels. For example, labels 12, 14 may be tracking labels which are secured to parcels, packages, and letters to identify the method of transport (i.e., by ground, air, etc.). When imaged, the coatings in area 18 provide unique bar code information which may be used to track the parcel.

Figure 3:
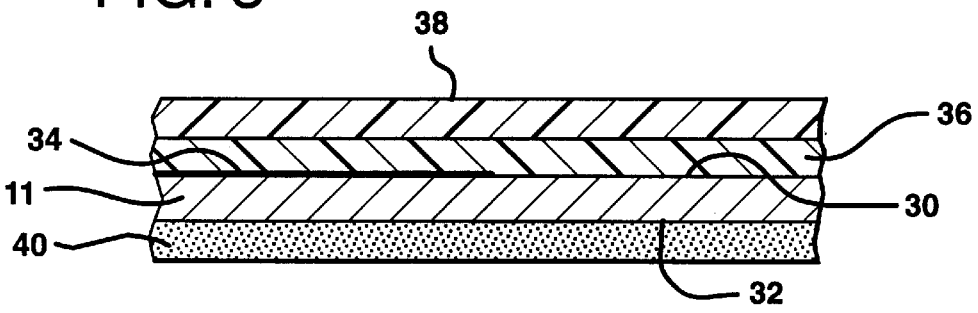
FIG. 3 is a sectional view of one label in a series illustrating one embodiment of the invention.

This embodiment of the label construction is also illustrated in FIG. 3 where a partial side sectional view of an individual label in the series is shown. The web 28 includes a first surface 30 and a second surface 32. The web can be any of a number of suitable materials including coated or uncoated paper, liner stock, calender liner (not siliconized), thermoplastic polymeric film, and heat resistant polymeric film. One example of a heat resistant polymeric film is a polyimide.

The first surface 30 of the web is coated on one or more selected portions with an imagable coating 34 of initially colorless color formers and color developers. As shown in this embodiment, the imagable coating is coated on only one selected portion of the label where, for example, bar code information is to be printed, while the remaining area of the label is uncoated. Alternatively, the imagable coating may be coated on two or more portions.

Suitable color formers for use in the present invention include colorless chromogenic dye precursors known in the art such as triphenyl methanes, diphenyl methanes, leuco dyes, xanthene compounds, thiazene compounds, and spiropyran compounds such as those described in U.S. Pat. No. 5,102,856, incorporated herein by reference. Many different shades or hues of color may be produced on a document by combining color formers which form blue, yellow, green and red colors. Black images may also be produced by using a combination of color formers. Preferably, the color formers comprise from about 5 to 15% by weight of the coating formulation.

The color developers may be selected from acidic color developers known in the phenolic resins, salicylate, acetylated phenolic resins, salicylic acid modified phenolic resins, zincated phenolic resins, novolac type phenolic resins, and other monomolecular phenols such as bisphenol A, 4,4'-isopropylidene diphenol, 4,4'-sulfonyl diphenol, p,p' (1-methyl-n-hexylidene) diphenol, p-tert-butyl phenol, and p-phenyl phenol. The color developer is preferably present in the coating formulation from about 15 to 30% by weight.

In addition, the coating contains from about 40–70% by weight water. Thermally activatable coatings preferably contain from about 5 to 25% by weight of a sensitizer. Such sensitizers are low melting point solids which, when subjected to heat, melt and become solvents for the color forming and developing reactants. Suitable sensitizers include B-naphthol benzyl ether, p-benzyl biphenyl, ethylene glycol-m-tolyl ether, m-Terphenyl, Bis [2(4-methoxy) phenoxy] ether, and dibenzyl oxalate.

A binder is also preferably included in the coatings to improve the Theological properties of the coating for better printability and to promote good adhesion of the coatings to the sheet surface. Suitable binders include starch, casein, polyvinyl alcohol, polyvinyl pyrrolidone, acrylamide/acrylate copolymers, carboxylated styrene butadiene latex, styrene acrylic latex, and mixtures thereof.

The coating formulation may also include from about 5 to 30% by weight of a pigment such as calcined clay, calcium carbonate, or plastic pigments. Other optional ingredients include from about 5 to 25% by weight of lubricant and from about 1 to 10% by weight of an anti-fading agent. The anti-fading agent may comprise hindered phenols of the antioxidant class such as 1,1,3-tris (2-methyl-4-hydroxy-5-cyclohexylphenyl) butane.

The coatings are generally applied to the web by any suitable coating or printing process including flexographic or gravure printing techniques. The coatings may be applied in selected areas which can form blocks of background color, or they may be applied so as to form images, symbols, stripes, borders, and the like when imaged. Coatings which produce different colors are preferably coated or printed separately on each desired portion of the web. The coatings are preferably applied at a dry coating weight of between about 0.50 and 2.50 lbs/17"×22"×500 sheet ream, and may be selectively printed or coated on the surface of stock papers during the manufacturing process, although it is preferred that they be applied in register with repetitive indicia and therefore applied in-line with printing operations.

As shown in FIG. 3, a base coating 36 preferably overlies the imagable coatings 34 which acts to fill in any voids or irregularities in web 11. The base coating also provides a smooth, receptive coating for the release material 38 which is applied over base coating 36. However, it should be noted that the base coating may not be needed on some substrates such as polymeric films which may already have a smooth surface.

Base coating 36 may be a water-based, solvent-based, or ultraviolet light or electron beam curable polymer which may be applied in liquid form. Examples of suitable base coating compositions are taught in commonly-assigned published PCT International Application No. WO 90/13064, published Nov. 1, 1990.

A coating of a release material 38 overlies base coating 36. The release material may be any suitable ultraviolet light, electron beam, or heat curable polymer including silicone based polymers and acrylate-based polymers. Examples of suitable release materials for use in the present invention are disclosed in commonly-assigned U.S. application Ser. No. 08/198,353. The release coating should be chosen so as to provide a release value for the labels when dispensed at a 90° angle of from about 60 to 160 gm/2 inch width.

Both base coating 36 and release material 38 must be substantially transparent so that the colored areas or images may be viewed therethrough. The formulations listed above meet that requirement.

Also as shown in FIG. 3, a coating of a pressure sensitive adhesive 40 is applied to the second surface 32 of web 11. Generally, the pressure sensitive adhesive may be selected from any of several known classes of compositions including hot melt or water based pressure sensitive adhesives and may be either permanent or repositionable. One example of a suitable pressure sensitive adhesive is a rubber-based hot melt adhesive, Fuller HM 1547, which is applied at a coating rate of from about 10 to 15 lb/ream (17'×22'×500 sheet ream).

Figure 9:
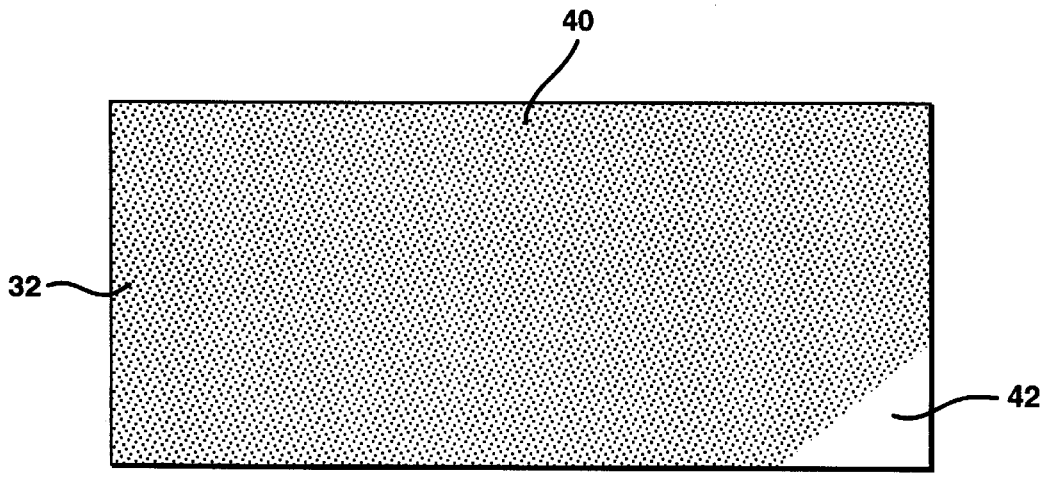
FIG. 9 is a bottom view of a label illustrating an alternative pattern of the pressure sensitive adhesive.

The pressure sensitive adhesive may also be pattern coated on the second surface 32 of the web as illustrated in FIG. 9, which shows an individual label in a series. For example, the label may be divided into two portions as shown, where one portion includes the pressure sensitive adhesive 40 and the other portion has no adhesive. The two portions may be separated by perforations 16 such that the portion without adhesive may be separated and used as a receipt or record, either before or after the label is adhered to another surface. The label may also include an adhesive free corner or edge 42 as illustrated in FIG. 9 to aid in peeling the label from the roll.

Figure 2:
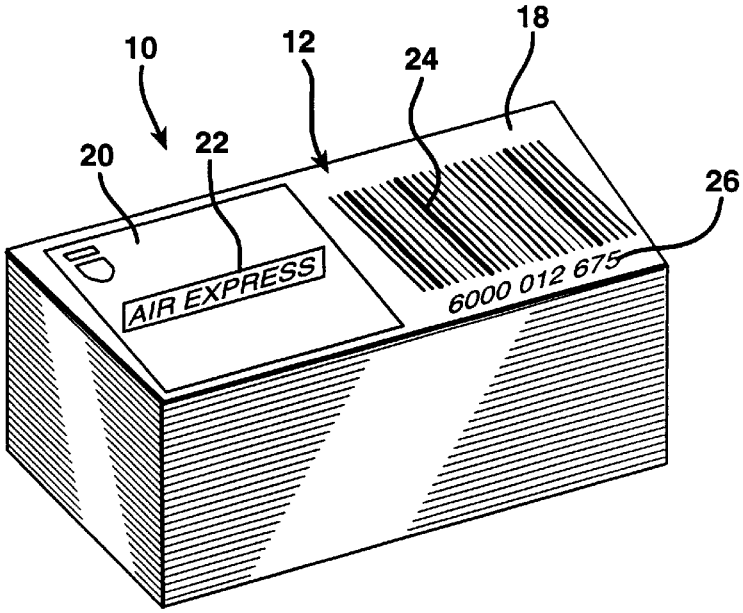
FIG. 2 is a perspective view of a stack of labels in accordance with the present invention.

In another embodiment of the invention illustrated in FIG. 2, the individual labels 12 are stacked on top of one another to form a stack from which the labels may be peeled away and dispensed one by one. Again in this embodiment, each label 12 includes at least one area 18 which has an imagable coating and an area 20 which includes a repetitive image 22 printed thereon. Preferably, in this embodiment, the pressure sensitive adhesive on the second surface of the substrate is pattern coated such that there remains at least a free-lifting edge as illustrated in FIG. 9 to aid in peeling each label from the stack.

Figure 4:
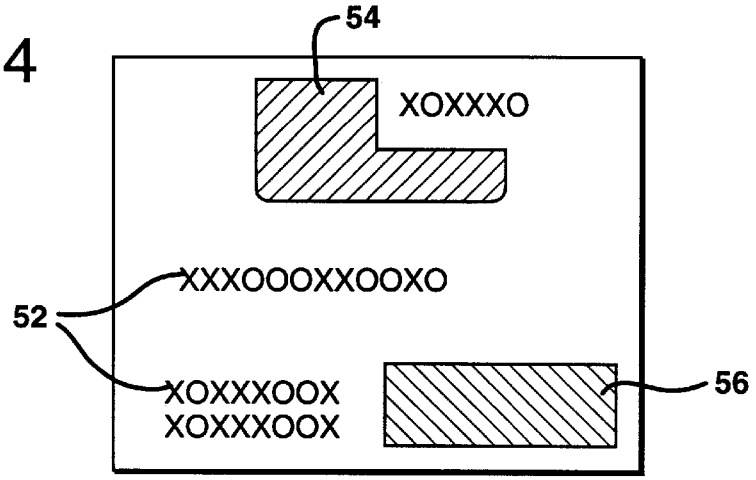
FIG. 4 is a plan view of one label in a series illustrating one possible pattern of the imagable coatings.
Figure 5:
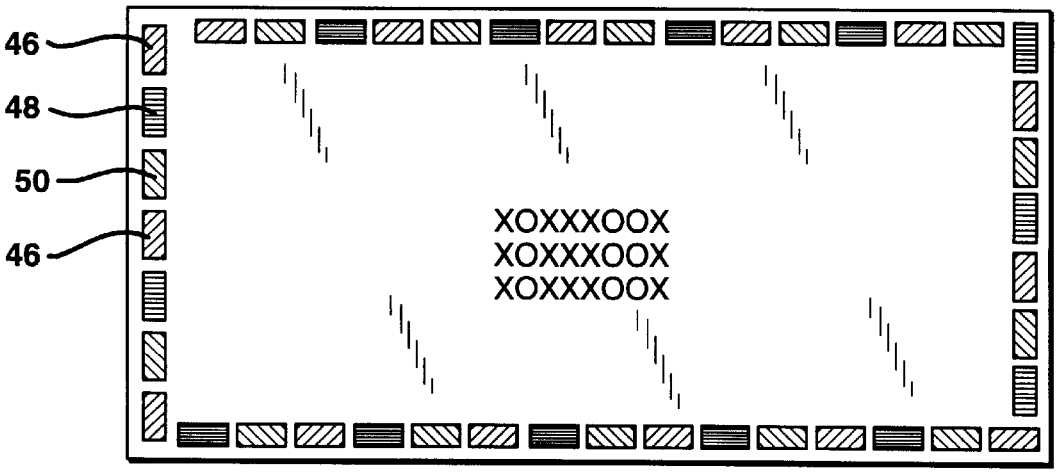
FIG. 5 is a plan view of another label in a series illustrating an alternative pattern of the imagable coatings.

FIGS. 4 and 5 illustrate varying arrangements of imagable coatings on individual labels in a series. Such labels may be in a series on a roll or stacked. FIG. 5 illustrates a label which is coated in selected areas to create different colored areas when imaged. If desired, the web may be preprinted with nonvariable, repetitive information by automated equipment and then coated in accordance with the present invention so that variable information may be printed in the color activatable areas. For example, as shown in FIG. 5, areas 52 contain preprinted repetitive information, area 54 is coated with a color former and color developer which forms a first color, and area 56 is coated with a color former and color developer which form a second color different from the first color.

As shown in FIG. 5, the coatings may also be applied in alternating side-by-side relationship about the periphery of a label. For example, block 46 is coated with a color former and color developer which form a first color, block 48 is coated with a color former and color developer which form a second color, and block 50 is coated with a color former and color developer which form a third color, with each of the colors differing from one another. Such an arrangement allows one color to be selectively activated around the boundary of the label to provide an indication of how the item to which the label is affixed is to be processed.

As can be seen in the drawing figures, the color former and color developer coatings may be printed on selected portions of a document or label in a number of patterns, depending on the desired application. It should be appreciated that many different combinations for placement of the coatings on a web or substrate are possible and are within the scope of this invention. While the embodiments illustrated show selected portions of a label containing the coatings, it should also be appreciated that the coatings may be applied as a full coating on a label.

Figure 6:
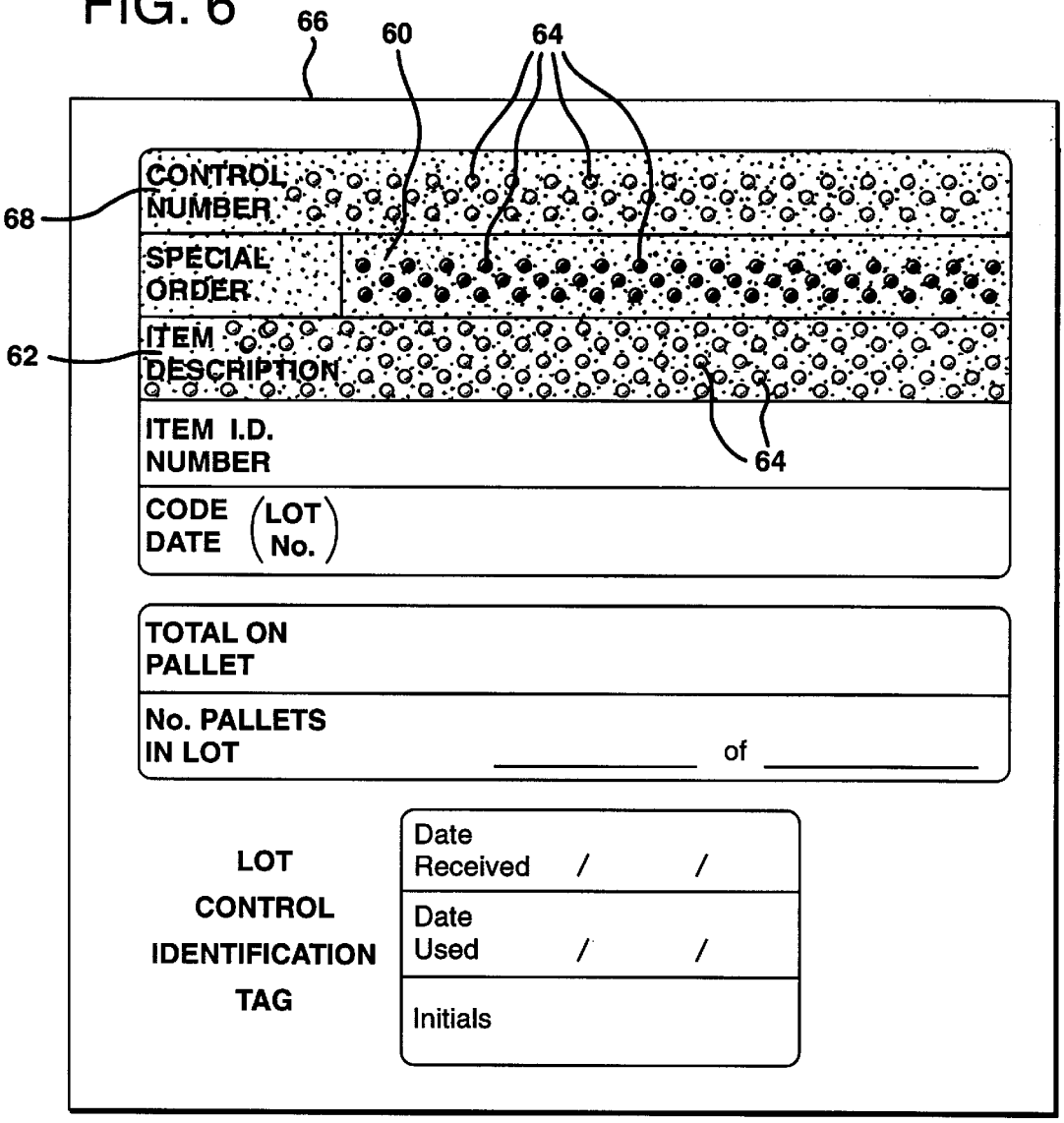
FIG. 6 is a plan view of a label in a series illustrating self-contained imagable coatings.
Figure 7:
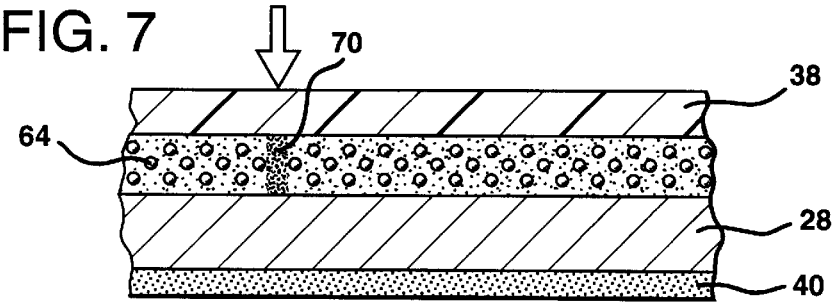
FIG. 7 is a fragmentary sectional view of a label illustrating the self-contained imagable coatings.
Figure 8:
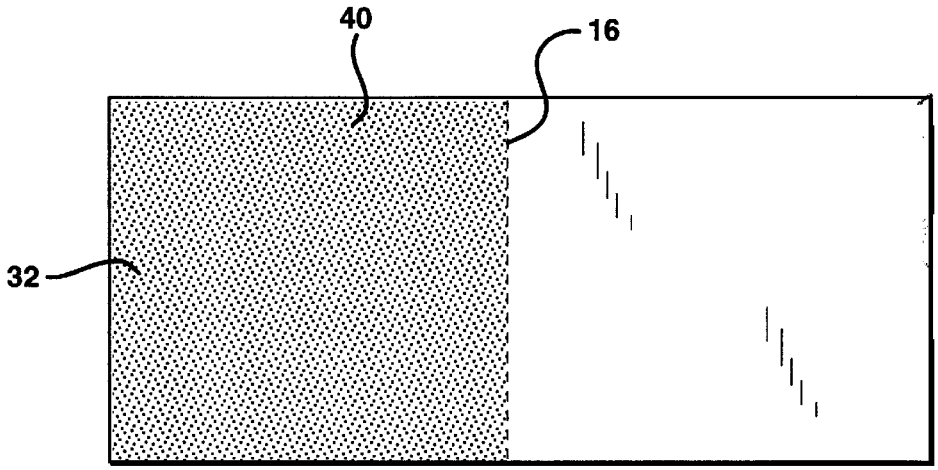
FIG. 8 is a bottom view of a label illustrating one pattern of the pressure sensitive adhesive.

FIGS. 6 and 7 illustrate yet another embodiment of the invention in which a label 66 in a series is shown having selected areas which may be activated to produce color upon the application of pressure. The label has been coated with self-contained coatings 64 comprising encapsulated color formers and color developers. The coatings are preferably applied at a dry coating weight of between about 0.30 and 3.00 lbs/17'×22'×500 sheet ream. In this embodiment, the color former-containing microcapsules may be produced by any method known in the art; however, a preferred method of microencapsulation is disclosed in Seitz, U.S. Pat. No. 4,889,877, the disclosure of which is incorporated by reference.

As shown in FIG. 7, when an imaging force, indicated by the arrow, applies pressure to the surface of the web 28 containing the self-contained coating 64, the color former and color developer combine to form a colored visible image 70 in the area beneath the imaging force. As shown in FIG. 6, area 68 is coated with a self-contained coating which forms a first color, area 60 is coated with a self-contained coating which forms a second color, and area 62 is coated with a self-contained coating which forms a third color, where the colors differ from one another.

The invention provides the advantage that a series of labels may be easily provided with a means of emphasizing or designating information on the label. As the imagable coatings are initially colorless, the entire web may be initially white, and only the information and colors required for a particular label need be activated. This permits the end user to print color customized labels or documents as desired. The invention also has the advantage that the colored images or areas may be provided by printing in a single pass through a thermal or impact printer.

Further, the invention allows a series of pressure sensitive adhesive labels to be wound in a roll or stacked without the need for a release liner.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A linerless continuous series of labels comprising:

a web having first and second major surfaces, said first surface of said web including on two or more selected portions thereof imagable coatings of color formers and color developers which may be activated to form different colored images or areas in said selected portions of said web, wherein said coatings which produce said different colored images or areas are applied to separate portions of said web, a coating of a release material on said first surface of said web which overlies said coatings of color formers and color developers; and a coating of a pressure sensitive adhesive on the second surface of said web.

2. A linerless continuous series of labels as claimed in claim 1 wherein said imagable coatings may be activated to form different colors in each of said selected portions.

3. A linerless continuous series of labels as claimed in claim 2 wherein only one selected portion is activated.

4. A linerless continuous series of labels as claimed in claim 1 including a series of repetitive images printed on at least a portion of one surface of said web, each of said repetitive images corresponding to an individual label in said series of labels.

5. A linerless continuous series of labels as claimed in claim 4 wherein said repetitive images are printed on a portion of said web which does not include said imagable coatings.

6. A linerless continuous series of labels as claimed in claim 1 wherein said series of labels are wound so that said coating of pressure sensitive adhesive contacts said release material to permit individual labels to be unwound and dispensed from the roll.

7. A linerless continuous series of labels as claimed in claim 6 including cross perforations between individual ones of said series of labels.

8. A linerless continuous series of labels as claimed in claim 1 in which said labels have a release value when dispensed at a 90° angle of from about 60 to 160 gm/2 inch width.

9. A linerless continuous series of labels as claimed in claim 1 including a base coating applied to said web prior to application of said release material.

10. A linerless continuous series of labels as claimed in claim 1 in which said web is selected from the group consisting of coated or uncoated paper, liner stock, calender liner, thermoplastic polymer film, and heat-resistant polymeric film.

11. A linerless continuous series of labels as claimed in claim 10 in which said web is a polyimide film.

12. A linerless continuous series of labels as claimed in claim 1 wherein said colored visible areas include images, symbols, or indicia.

13. A linerless continuous series of labels as claimed in claim 1 wherein said color formers and color developers combine to form colored visible areas when exposed to an imaging force of heat.

14. A linerless continuous series of labels as claimed in claim 1 wherein said imagable coating has been coated as a pattern on said web.

15. A linerless continuous series of labels as claimed in claim 1 wherein said color formers and color developers combine to form colored visible areas when exposed to an imaging force of pressure.

16. A linerless continuous series of labels as claimed in claim 15 wherein said imagable coatings comprise self-contained coatings of pressure-rupturable microcapsules containing either said color formers or said color developers.

17. A linerless series of labels comprising:

a series of substrates having first and second surfaces, said first surface of each substrate including on two or more selected portions thereof an imagable coating of color formers and color developers which may be activated to form different colored images or areas in said selected portions of each substrate, wherein said coatings which produce said different colored images of areas are applied to separate portions of each substrate, a coating of a release material on said first surface of each substrate which overlies said coatings of color formers and color developers; and a coating of a pressure sensitive adhesive on the second surface of each substrate; wherein said series of labels are stacked so that said coating of pressure sensitive adhesive on the second surface of one substrate in said series contacts the release material on said first surface of another substrate in said series to permit individual labels to be dispensed from the stack.

18. A linerless continuous series of labels comprising:

a web having first and second major surfaces, said first surface of said web including on one or more selected portions thereof a series of imagable coatings of color formers and color developers which may be activated to form different colored images or areas in said selected portions of said web, wherein said coatings which produce said different colored images or areas are applied to separate portions of said web;

a coating of a release material on said first surface of said web which overlies said coatings of color formers and color developers; and a pressure sensitive adhesive pattern coated on the second surface of said web.

19. A linerless continuous series of labels comprising:

a web having first and second major surfaces, said first surface of said web including on selected portions thereof a series of imagable coatings of color formers and color developers which may be activated to form different colored images or areas in said selected portions of said web, with the remaining areas of said web not containing said imagable coatings, wherein said coatings which produce different color images or areas are applied to separate portions of said web;

a coating of a release material on said first surface of said web which overlies said coatings of color formers and color developers; and a coating of a pressure sensitive adhesive on the second surface of said web.

20. A linerless continuous series of labels comprising:

a web having first and second major surfaces, said first surface of said web including on one or more selected portions thereof a series of imagable coatings of color formers and color developers which may be activated to form different colored images or areas in said selected portions of said web, wherein said coatings which produce said different colored images or areas are applied to seperate portions of said web, with the remaining portions of said first surface of said web not containing said imagable coatings and including a series of repetitive images thereon, each of said series of imagable coatings in conjunction with one of said repetitive images forming a label in said series of labels;

a coating of a release material on said first surface of said web which overlies said coatings of color formers and color developers; and a coating of a pressure sensitive adhesive on the second surface of said web.

* * * * *

UNITED STATES PATENT AND TRADEMARK OFFICE

CERTIFICATE OF CORRECTION

PATENT NO : 5,840,657

DATED : November 24, 1998

INVENTOR(S) : Rajendra Mehta et al.

It is certified that errors appear in the above-identified patent and that said Letters Patent is hereby corrected as shown below:

The title "IMAGABLE LINERLESS PRESSURE SENSITIVE ADHESIVE" should read -- IMAGABLE LINERLESS PRESSURE SENSITIVE ADHESIVE LABELS--.

Signed and Sealed this

Twenty-third Day of March, 1999

*Attest:*

Q. TODD DICKINSON

*Attesting Officer*

*Acting Commissioner of Patents and Trademarks*